US007189914B2

(12) United States Patent
Mack

(10) Patent No.: US 7,189,914 B2
(45) Date of Patent: Mar. 13, 2007

(54) AUTOMATED MUSIC HARMONIZER

(76) Inventor: Allan John Mack, "Rosewood" PO Box 55, Williamstown, S A (AU) 5351

( * ) Notice: Subject to any disclaimer, the term of this patent is extended or adjusted under 35 U.S.C. 154(b) by 0 days.

(21) Appl. No.: 10/416,143

(22) PCT Filed: Nov. 13, 2001

(86) PCT No.: PCT/AU01/01464

§ 371 (c)(1),
(2), (4) Date: May 5, 2003

(87) PCT Pub. No.: WO02/41295

PCT Pub. Date: May 23, 2002

(65) Prior Publication Data

US 2004/0025671 A1 Feb. 12, 2004

(30) Foreign Application Priority Data

Nov. 17, 2000 (AU) ..... PR 1507

(51) Int. Cl.
*G10H 1/38* (2006.01)
*G10H 7/00* (2006.01)

(52) U.S. Cl. ..... 84/613

(58) Field of Classification Search ..... 84/613, 84/637, 650, 669
See application file for complete search history.

(56) References Cited

U.S. PATENT DOCUMENTS

| | | | | | |
|---|---|---|---|---|---|
| 5,003,860 | A * | 4/1991 | Minamitaka | 84/609 |
| 5,322,966 | A * | 6/1994 | Shimaya | 84/637 |
| 5,418,325 | A * | 5/1995 | Aoki et al. | 84/613 |
| 5,496,962 | A * | 3/1996 | Meier et al. | 84/601 |
| 5,760,325 | A * | 6/1998 | Aoki | 84/613 |
| 5,850,051 | A * | 12/1998 | Machover et al. | 84/634 |
| 5,883,326 | A * | 3/1999 | Goodman et al. | 84/649 |
| 6,060,655 | A * | 5/2000 | Minamitaka | 84/650 |
| 6,369,311 | B1 * | 4/2002 | Iwamoto | 84/615 |

* cited by examiner

*Primary Examiner*—Jeffrey W Donels

(57) ABSTRACT

In the field of music, good practice in the writing of harmony has been encapsulated in an extensive set of formal rules. It is a difficult and tedious mental task to check music for compliance. However, music so harmonized almost always sounds pleasing. In the present invention, a Harmonizer harmonizes a melody in accordance with the rules using an iterative technique of chord selection, permutation and submission to the rules until solutions are found. At difficulties, the Harmonizer can compromise preferences, in order to produce an optimum solution. The process is characterized by advances and retreats along the melody and is therefore suited to subsequent performance and not to real-time applications.

3 Claims, 1 Drawing Sheet

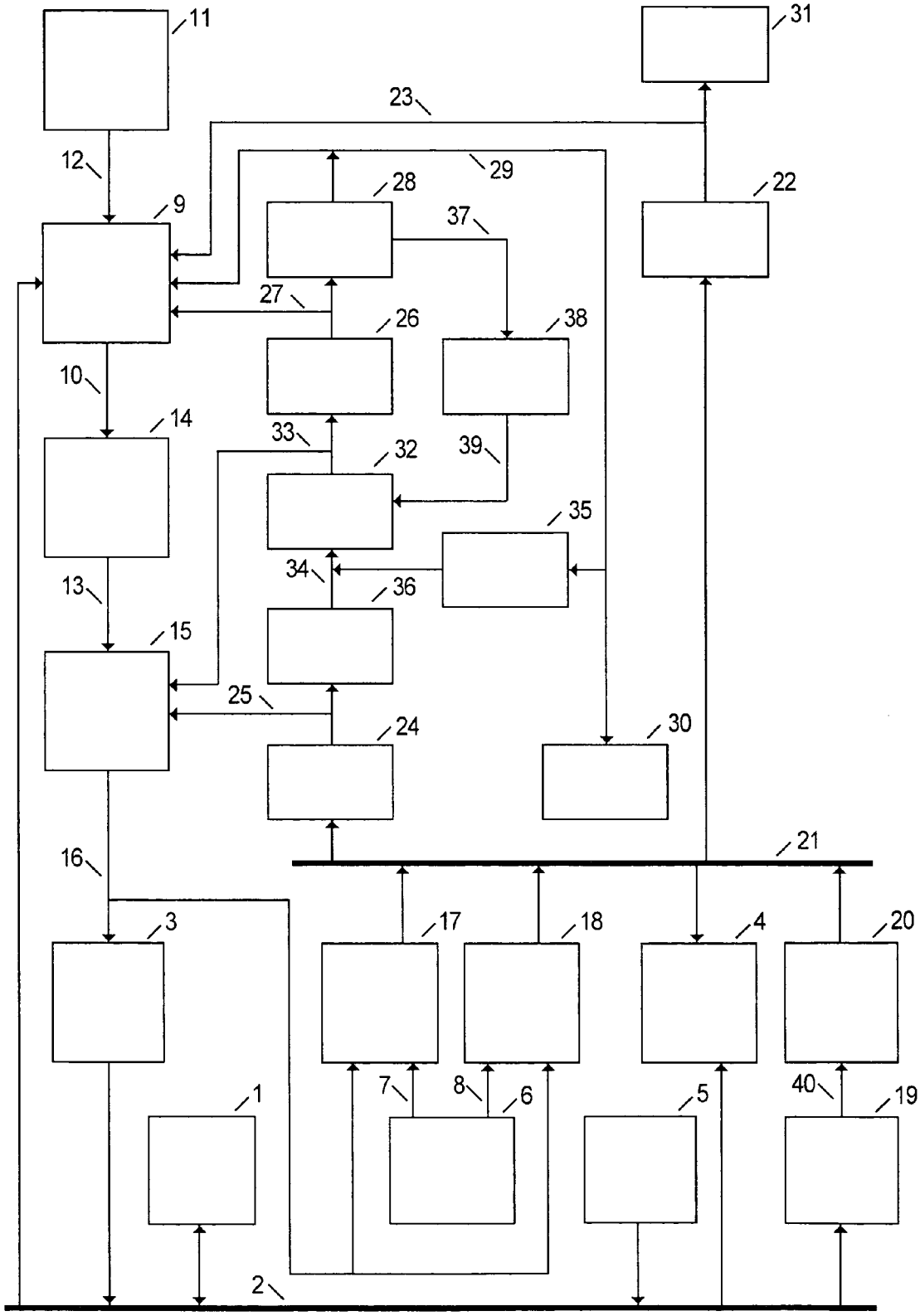
11
31
23
12
29
28
22
9
37
27
26
38
10
14
33
32
39
35
34
36
13
15
25
24
30
21
16
3
17
18
4
20
1
7
8
6
5
40
19
2

AUTOMATED MUSIC HARMONIZER

CROSS-REFERENCE TO RELATED APPLICATIONS

Foreign Application Priority Data

International PCT Application PCT/AU01/01464 filed 13 Nov. 2001. Australian Provisional Application PR1507 filed 17 Nov. 2000.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The field of the invention is music. More specifically, the field is automated creation of harmony for melody and analysis of music. The best Implementation is in software form.

Definitions

The terms "harmony rules" and "rules of harmony" each refer to the body of knowledge accumulated over recent centuries by specialists and others in the field of music which knowledge is recognized as preferred practice in the use of harmony. The rules are exemplified in the book "Longmans' Music Course Part II—Harmony and Counterpoint", by T. H. Bertenshaw, Longmans Green and Co., Ltd., London (1926).

The musical term "note" implies, inter alia, its pitch (some writers use the term "tone" for note).

Terms distinguished by an initial upper case are defined for the easier reading of this document:

"Implementation" refers to "mode for carrying out the present invention".

"Melody" refers to a time series of notes having at least one note.

"Harmonizer" refers to harmonizer means in the present invention for creating an accompaniment.

"Rules" refers to the harmony rules accessible by and used by the present invention. See "Representative List of Harmony Rules" appended to the description.

"Controls" refers to parameters determined by the user of the Harmonizer. Controls direct the Harmonizer process. Controls are fixed for the duration of harmonizing a Melody.

"Preferences" refers to parameters not being Controls some of which are determined by the user of the Harmonizer and others of which are preset by the Harmonizer. Preferences direct the harmonizing process. The Harmonizer can weaken (compromise) Preferences.

"Preceding Melody Note" means melody note at which a chord was most recently created preceding the current melody note.

(2) Background Art

Traditional Methods

Music has long been harmonized manually. That is, whether composers enter the notes or chords into a machine, such as a computer, or write them by hand, they rely on their knowledge of the rules of harmony, or on what they think sounds good to their own ear. It is a tedious process, it is possible to miss the best solution, and it is difficult to comprehend simultaneously all the many rules. It is easy to find errors in compositions of even the great composers, including Bach; and Mendelssohn is noted (Bertenshaw, cited) for breaking the rules.

It is recognized that breaking the rules is sometimes deliberate in order to achieve a particular effect, and the best Implementation does not preclude this being done manually after harmonizing.

Traditional methods of harmonizing include manual iterative procedures in which, upon the seemingly satisfactory creation of a chord, the composer advances to create the next. The composer will often have a pre-conception of what chord should be used, but may find that, after attempting various permutations of the chord parts, the Rules cannot be accommodated. If this remains the case after trying several of the better choices of chords, the composer, rather than trying a poorer choice, will retreat to the previous chord to try alternatives there. If several such iterations are necessary, the composer may try something more radical at an earlier chord in the hope of finding a solution more readily. The Harmonizer formalizes each of these processes, with the qualification, however, that even at the point of trying "something more radical" it will not break the Rules. None of the following inventions discloses this kind of iteration.

Another tedious and error prone manual process is the recognition of species, degree, inversion, mode, intervals and semitones of chords in music. The present invention discloses features which derive these chord parameters from the music using that part of the Harmonizer which analyzes chords, and which present them to the user and which annotate music with chord notation and figured bass.

Where a composer wishes to create or alter harmony manually, there is difficulty in recalling and applying the many rules of harmony, as already stated. The present invention discloses features which display breaches of the rules to the user using that part of the Harmonizer which analyzes chords according to the Rules.

Comparison with other Inventions

Citations

U.S. Pat. No. 5,525,749 Aoki; Eiichiro

U.S. Pat. No. 5,496,962 Meier; Sidney K.; Briggs; Jeffrey L.

U.S. Pat. No. 5,451,709 Minamitaka; Junichi

U.S. Pat. No. 4,982,643 Minamitaka; Junichi

U.S. Pat. No. 4,926,737 Minamitaka; Junichi

U.S. Pat. No. 6,124,543 Aoki; Eiichiro

U.S. Pat. No. 5,760,325 Aoki

U.S. Pat. No. 5,418,325 Aoki et al.

U.S. Pat. No. 5,883,326 Goodman et al.

U.S. Pat. No. 6,369,311 Iwamoto; Kazuhide

U.S. Pat. No. 5,850,051 Machover et al.

U.S. Pat. No. 5,003,860 Minamitaka

U.S. Pat. No. 6,060,655 Minamitaka; Junichi

U.S. Pat. No. 5,322,966 Shimaya; Hideaki

The following comparisons with other inventions are based only upon the present inventor's understanding of them and are made in good faith.

Comparison with U.S. Pat. No. 5,525,749 Aoki; Eiichiro

The invention of U.S. Pat. No. 5,525,749 is described as a composition/arrangement assistant, in which a set of notes (referred to as tones) based on the melody note and the melody tonality (scale and mode) is presented to the user who then selects notes from that set for the other voices of the arrangement. Compliance with the rules of harmony, except for a few mentioned below, is left to the judgement of the user.

The present invention differs in that formal chords, characterized by degree, mode, species and inversion, are developed successively from internal chord specifications. The present invention assigns notes to each voice without user involvement, assesses the chord, and reallocates the parts or chooses another chord if the former chord is unsatisfactory. The harmonizing of the Melody proceeds to completion without user interaction.

The invention of U.S. Pat. No. 5,525,749 prohibits consecutive (parallel) fifths and octaves and prohibits minor ninths from the melody. This can be done without a knowledge of the species of chords, and represents a very small portion of the rules of harmony developed over the recent centuries. The present invention is distinguished by its ability to identify chords by degree, mode, species and inversion, and by its ability to identify the distribution of chord parts amongst the voices. This information is essential as the present invention then proceeds to assess chords for their compliance with the many rules of harmony available to it.

The present invention is therefore distinguished in that it proceeds without user intervention and that it produces an accompaniment in accordance with the Rules.

Comparison with U.S. Pat. No. 5,496,962 Meier; Sidney K.; Briggs; Jeffrey L.

The invention of U.S. Pat. No. 5,496,962 creates a plurality of options, analyzes those options exhaustively, attributes weighting factors to those options, and chooses the "best". Refer to "Chord Selection" below. The present invention accepts the first chord found which satisfies the Controls, the Preferences and the Rules, and looks further only if it later retreats to the current melody note.

The invention of U.S. Pat. No. 5,496,962 composes original music, employing randomness amongst other processes, whereas the present invention creates, without randomness, parts for voices to accompany an existing Melody that is provided by the user. With the same user settings, the present invention exhibits repeatability.

Comparison with U.S. Pat. No. 5,451,709 Minamitaka; Junichi

The invention of U.S. Pat. No. 5,451,709 is an automatic composer using (dynamic) databases of melody progressions and chord progressions and employing pattern matching in the creation of melodies and chords. Although the invention discloses repetition of processes in order to optimize choices, it is intended to compose and play in real time. Refer to "Real Time Devices" below. The testing referred to in its claim 13 is against conditions which have been set, apparently by the user. The invention does not refer to the rules of harmony, whereas the present invention relies heavily on them. Rather than having a database of preferred progressions, the present invention achieves good chord progression as a consequence of enforcing the many rules of harmony. Refer to "Chord Selection" below.

Comparison with U.S. Pat. No. 4,982,643 Minamitaka; Junichi

The comments on U.S. Pat. No. 5,451,709 apply here also. References to "rules" in the disclosure of this and the previous invention refer to the rules of a knowledge base (expert system) and not to harmony rules.

Comparison with U.S. Pat. No. 4,926,737 Minamitaka; Junichi

The invention of U.S. Pat. No. 4,926,737 is an automatic composer using a melody motif. It relies on a (dynamic) database of chord progressions. The earlier comments under U.S. Pat. No. 5,451,709 on rules and chord progression apply here. The invention of U.S. Pat. No. 4,926,737, as a composer, is naturally concerned with the development of a pleasing melody, and much is made of the detection of "non-harmonic tones".

The user is involved in the selection of chords for Melody notes. By contrast, the present invention accepts a Melody from the user, and the quality and style of the harmony produced is naturally dependent on the quality and style of the Melody. There is no user intervention during processing.

Comparison with U.S. Pat. No. 6,124,543 Aoki; Eiichiro

The invention of U.S. Pat. No. 6,124,543 analyzes the melody to be accompanied and compares the melody with a melody example. Refer to "Melody Analysis" and "Use of Examples" below.

Comparison with U.S. Pat. No. 5,760,325 Aoki; Eiichiro

The invention of U.S. Pat. No. 5,418,325 derives rules from an input series of notes (melody). Chord selection is further based on examples of chord progressions. The invention appears to be an interactive device. Refer to "Melody Analysis" and "Chord Selection" below. There is no suggestion of revision of chord selections, whereas the present invention can revise the choice of chord. Refer to "Retreat and Revision" below.

Comparison with U.S. Pat. No. 5,418,325 Aoki et al.

The invention of U.S. Pat. No. 5,418,325 derives rules from an input series of notes (melody). Refer to "Melody Analysis" below. It describes a real time operation—refer to "Real Time Devices" below. It requires the input of at least one chord accompanying the input melody, and creates harmony by an assessment of non-harmonic notes, that is, passing notes and their allies. Refer to "Chord Selection" below.

Comparison with U.S. Pat. No. 5,883,326 Goodman et al.

The invention of U.S. Pat. No. 5,883,326 requires an example of melody and harmony. It derives rules by analysis from the example and applies them to a second melody (claim 1). Significantly, the outcome of applying the rules to the second melody is not stated in the claim. Refer to "Use of Examples" and "Chord Selection" below. All of the musical knowledge of the present invention is confined to fixed rules and tables. Refer also to "Real Time Devices" below. U.S. Pat. No. 5,883,326 refers to a class of inventions typified by U.S. Pat. No. 5,308,915 which make use of neural networks. Neural networks behave in a manner dissimilar to that of the present invention in that they learn from examples. The present invention has no learning capability.

Comparison with U.S. Pat. No. 6,369,311 Iwamoto; Kazuhide

The invention of U.S. Pat. No. 6,369,311 creates an accompaniment for a melody according to examples of other performances (compositions). Refer to "Use of Examples" below.

Comparison with U.S. Pat. No. 5,850,051 Machover et al.

The invention of U.S. Pat. No. 5,850,051 discloses a device responding to performances. Its distinguishing feature appears to be its capability of revising the operator's requirements by analysis of the operator's performance (the melody). Refer to "Melody Analysis" below. The invention of U.S. Pat. No. 5,850,051 discloses a real-time device. Refer to "Real Time Devices" below.

Comparison with U.S. Pat. No. 5,003,860 Minamitaka

The invention of U.S. Pat. No. 5,003,860 requires chords to be specified with the melody. Refer to "Chord Selection" below. It operates in real time. Refer to "Real Time Devices" below. The invention of U.S. Pat. No. 5,003,860 analyzes music input to determine key (changes), whereas the present invention does not—key and rhythm changes are explicit.

Comparison with U.S. Pat. No. 6,060,655 Minamitaka; Junichi

Refer to "Chord Selection" below. The invention of U.S. Pat. No. 6,060,655 requires an input of chord progression examples which evolves with use. Refer to "Use of Examples" below. The present invention assesses progression after the allocation of chord parts to voices.

Comparison with U.S. Pat. No. 5,322,966 Shimaya; Hideaki

The invention of U.S. Pat. No. 5,322,966 determines a chord type given a chord. Refer to "Chord Selection" below—the reverse process. The invention of U.S. Pat. No. 5,322,966 describes a real time operation. Refer to "Real Time Devices" below.

Melody Analysis

The present invention scans the Melody to assess the positions of beats and cadences. Beats and cadences are determined according to the duration of Melody notes, not to their pitch.

Rather than using rules, derived from the Melody or otherwise, for the selection of chords, the present invention takes each chord (specification) in order unconditionally, and only subsequently determines whether the chord should be rejected. The present invention analyzes the melody in combination with the harmony created, for compliance with the Rules, rather than to determine the style or nature of the melody.

Chord Selection

The present invention does not use rules to select chords for the melody, but rather selects from fixed tables chord specifications according only to the degree of the current melody note and the current mode of the melody. It constructs harmony from the chord specification, accounting for the melody note only in the formation of doubles, and only then tests the harmony against a fixed set of rules. Rather than selectively choosing acceptable chords, the present invention takes all chords and rejects unacceptable ones by analysis.

Use of Examples

The present invention uses no example melodies, performances or compositions. Whereas there is an extensive set of harmony rules considered in the art as correct practice, breaches of the rules can be found in the works of most composers. The use of examples from which to derive rules is therefore likely to propagate those breaches. In the context of a different albeit similar composition, those breaches may produce harmony inferior to that obtained in the present invention complying with the Rules.

Retreat and Revision

The present invention, when unable to harmonize a melody note according to Preferences, Controls and Rules, retreats to the Preceding Melody Note to revise the harmony there.

Real Time Devices

Because earlier harmony has already been sounded, real time devices cannot retreat along melody notes to revise earlier harmony, whereas retreat to revise earlier harmony is a significant feature of the present invention. The present invention is unsuited to real time use.

Summarising the Comparisons

The present invention appears to be unique in distinguishing harmony rules that must be complied with, from preferences that may be compromised. Its use of a comprehensive set of harmony rules as a significant component in the process of harmonizing appears to be unique. The present invention appears to be unique in its capability, when unable to select suitable harmony, to retreat to an earlier melody note to revise the choice of harmony there. The revision of earlier harmony gives the present invention a distinct advantage over others.

The present invention appears to be unique in its repeatability for given Melody, Controls and Preferences. There is no random process in the present invention.

BRIEF SUMMARY OF THE INVENTION

The principle object of the present invention is to provide a system for automated generation of accompaniment for Melody in accordance with harmony rules.

An object is to provide a system for analysis of music for compliance with harmony rules.

Another object is to provide a system for analysis of chords for degree, inversion, mode, intervals, semitones and figured bass.

Yet another object is to provide a system for presentation of data from said analysis of music and of chords to the user for any music input to the invention.

The invention provides a harmonizer for harmonizing which comprises storing means for storing chord specifications for melody notes, advancing and retreating means for selecting melody notes one by one, selecting means for selecting a chord specification for a melody note, filling means for creating harmony parts of a chord according to the chord specification, testing means for analyzing music thus formed and revising means for revising chord specification selection and part creation.

Among the features of the present invention, the system provides means for user input of Melody, for user setting Controls and Preferences, for user submission of the Melody to the Harmonizer. Some examples of Preferences are the extent of leaping permitted, the separation of each voice, variation from the harmony of preceding chords, and the requirements of cadences. Some examples of Controls are the number of voices required to be created, the range limits of each voice and the frequency of Melody notes at which chords are to be created.

Further among the features of the present invention, the system provides means for the Harmonizer to test whether music meets a plurality of criteria, some examples being the extent of leaping permitted, the range limits and separation of each voice, the overlapping and crossing of voices, variation from the harmony of preceding chords, and the requirements of cadences.

Further among the features of the present invention, the system provides means for the Harmonizer to place successive chords successfully so created and tested into the music and means for "submission of the music to the Rules", until a rule compliant chord is obtained, in which case the Harmonizer advances to the next Melody note.

The "submission of the music to the Rules" process involves, for said successive chords and Melody notes, "identifying chords", identifying passing notes and their allies, and analyzing said successive chords, Melody notes and passing notes according to the Rules.

The "identifying chords" process involves identifying voice intervals and semitones, and matching said intervals and semitones against a plurality of chord structures, some of said chord structures defined procedurally and others defined in tabular form.

Further among the features of the present invention, the system provides means for the Harmonizer to compromise progressively in order some of said criteria when the Harmonizer is unable to find a chord satisfying both present criteria and the Rules, and means to re-iterate said chord specification selection, chord creation, chord testing and chord submission to the Rules. Compromised criteria thus implement Preferences. Others of said criteria are Controls, not compromised.

Further among the features of the present invention, the system provides means for the Harmonizer, upon compromising the criteria to the greatest degree allowed and failing to obtain a rule compliant chord, to retreat to the previous Melody note as if the chord there had failed the criteria last applicable there, and means for exiting the Harmonizer upon retreating past the first Melody note.

Further among the features of the present invention, the system provides means for the Harmonizer to advance to the next Melody note upon said obtaining of a rule compliant chord, and means for exiting the Harmonizer upon passing the last Melody note.

The harmonizing process is therefore characterized by advances and retreats along the Melody in user-nominated steps, with regions of compromised Preferences occurring if and where the Harmonizer has difficulty in complying with the Preferences, Controls and Rules.

The number of voices created as harmony above and below the melody is not limited in the present invention. One Implementation permits the creation of a) three voices below the Melody with b) an optional fourth voice above the Melody being the descant, and c) four voices below the Melody.

In a feature of the present invention, the system provides rules analysis means for analyzing any music held within the system for Rules compliance according to said "submission of the music to the Rules", and display means for displaying to the user failures of said Rules compliance. In this context, a plurality of said failures is obtained, whereas in the context of harmonizing it is sufficient to exit the said rules analysis at the first failure.

In another feature of the present invention, the system provides chord characteristics display means using said "identifying chords" process for the display of the characteristics of any user-selected chord.

Summarizing the Advantages

The present invention allows a user to move quickly from a Melody to a complete composition that complies with the Rules. Its capability to retreat and revise harmony is more likely to produce pleasing harmony. Using a computer system with an appropriate sound system, the user may assess the composition aurally with selected instrumentation. The user may then refine Preferences and Controls, for re-submission to the Harmonizer. The deterministic nature of the Harmonizer allows the user to make meaningful comparisons of alternative Preferences and Controls and to return to an earlier harmony confident of repeatability. Assessment of the several harmonies so created may lead the user to re-assess the Melody.

BRIEF DESCRIPTION OF THE SEVERAL VIEWS OF THE DRAWING(S)

The drawing is a data flow diagram exemplifying the principal data paths and processing blocks of the present invention. For clarity, some features disclosed but not claimed are omitted. The drawing is not to be construed as limiting the present invention.

DETAILED DESCRIPTION OF THE INVENTION

The best Implementation is implied unless explicit reference is made to other modes of the invention. The invention comprises software operating in a personal computer system (PC) comprising central processing unit, random access memory, hard disk, monitor, keyboard and optionally mouse, printer, sound card with audio system, and CD burner. The user interacts with the present invention by means of the monitor and the keyboard and the optional mouse. That is, there are keyboard equivalents for each mouse operation. Execution of the software in a PC is conventional.

Data Structure

The system provides means for music storing 1 of music data 2 comprising notes, chords, marks, expression, speeds, rhythms and keys according to voice and to time order. The access to particular notes and chords is by array subscripts corresponding to columns. The music data 2 also represent the music layout, and so some columns can be empty. The music storing 1 receives output from writing 3, and therefore is designed to store multiple-voice music data 2.

The system provides conventional output 4 for showing the user the music data 2.

The system provides conventional input 5 by which the user establishes music data 2 in the music storing 1 by editing and by file input.

In another Implementation the system provides conventional input 5 by which the user establishes Melody music data 2 in the music storing 1 by input interface hardware.

Harmonizer Invocation

In a feature of the invention, the system provides invocation 6 comprising a panel of options for the user to setup Harmonizer Preferences 7 and Controls 8 and to start the Harmonizer.

The Preferences 7 comprise the value of limit of leaping permitted;

the value of variation of harmony at Melody pitch repetition;

the choice of compliance with modulation detected at cadences;

the value of degree of close harmony;

the choice of avoidance of unison of adjacent voices; and the choice of variation (motion) of bass voice pitch at bars (measures), such that the user sets Preferences 7 by appropriate values and choices.

The Controls 8 comprise the value of chord frequency ranging from one-per-Melody-note, through intermediate frequencies some including syncopation and some excluding tied Melody notes, to one-per-bar;

the choice of variation of tied cadences where otherwise at cadences tied repeated Melody notes are treated as the second note of a cadence pair;

the value of voice range limits of accompanying voices;

the choice of extension of the tenor-to-bass interval limit by two beyond the one octave which is otherwise and elsewhere enforced between adjacent voices;

the choice of soprano voice or descant (solo) voice as the Melody voice;

the choice of an optional descant as a "vocal" and "instrument" voice, the instrument voice having greater freedom of interval from the Melody;

the choice of "true descant" meaning a descant which can be omitted from a composition without losing essential harmony; and the choice of copying notation (ties and staccatos) from the Melody to other voices, such that the user sets Controls 8 by appropriate values and choices.

The Harmonizer comprises a suite of procedures. The procedures perform the processes of harmonizing according to the following descriptions:

Harmonizer Start

Upon the user selecting the option to start the Harmonizer, invocation 6 first scans the Melody to establish the position and nature (accents) of beats (pulses), to establish iteration links according to said chord frequency, to establish the position of middle and final cadences, and to detect inappropriate Melody chromatics according to the scale mode.

Upon inappropriate Melody chromatics, the invocation 6 terminates processing with a diagnostic.

The Melody notes at which chords are required according to said chord frequency are termed "nominated melody notes".

Said iteration links are array subscripts.

In the best Implementation, the Harmonizer does not enforce the chord progression requirements of either the Rules or other user requirements, over section marks or Melody rests. These points are termed "melody breaks". Retreats over melody breaks are therefore never advantageous and so the Harmonizer is prohibited from doing so.

Final Cadences are created before section marks, the Melody note there permitting.

The Harmonizer starts at the first nominated melody note.

First, the Harmonizer process is described in more general terms, that is, with several nominated melody notes preceding and following the point of discussion. Then end points are discussed.

Harmonizer process

In accordance with the scale mode and the degree of the nominated melody note the Harmonizer selects 9 a chord specification 10 from specification storing 11 in which are chord specifications 12 in order of preference for each of the scale notes and chromatic notes of a plurality of scale modes. In the best Implementation, each chord specification 10 has a particular inversion. The said chord specifications 12 are stored as a data array. In another Implementation the said chord specifications 12 are defined by stored procedures.

The Harmonizer rejects some unsuitable chords, based on their degree, species or inversion. One example of said rejections is a Rule, namely, that common chords of degree one and two may not follow the other. As another example, a user Preference may be that chords vary their degree upon Melody note repetitions. As yet another example, not all the chords in the table are necessarily acceptable at cadences. All such rejections are deemed chord failures—see # below.

If there are insufficient parts in the chord 13 for the number of voices being created 14, filling 15 doubles some parts. The preferred parts to double in most chord species are defined in the rules of harmony and so this is one example of a Preference not controlled by the user. Filling 15 allocates parts to the voices 16, and preference testing 17 and control testing 18 test the voices for excessive range, excessive leaping, overlap, excessive separation and user Preferences 7 including but not limited to close harmony, varying parts upon Melody note repetitions, and avoiding unison. In the best Implementation, because chords selected from said chord specifications 12 have a particular inversion, if the user Preference 7 for bass motion fails, then the chord is deemed to fail—again see # below. In the case of other failures, the chord is deemed not to have complied with the Rules, otherwise the writing 3 places the chord into the music data 2, and submits the music data 2 to identifying 19 and diagnosing 20 according to the Rules.

At compliance 21 with the Rules, advancing 22 advances to the next nominated melody note 23.

In the case of Rule non-compliance, re-assigning 24 iterates with permutating 25 of the parts other than the bass, except in those cases of the Rules where permutations cannot remedy a failure. Consistent with the requirements of overlap, crossing, unison and spread, it is sometimes possible to move a part by an octave to form a new permutation. Further permutations comprise all permutations of preferred alternative parts to be doubled according to the number of additional parts needed; and the omission of fifths in certain chord species. In implementations where chord specifications 12 do not include chord inversion, the bass is included in the part permutations.

If all permutatings 25 fail the Rules, a chord failure is deemed.

In the case of a chord failure, the chord iteration 26 points to the next chord 27.

If there is no next chord 27 then retreating 28 retreats to the preceding nominated melody note 29, deems the chord there to have failed the Rules, and iterates accordingly.

End points

In the absence of a preceding melody note 29, at the beginning of the Melody or following a melody break, failing 30 terminates processing having failed to find a solution.

In the absence of a next melody note 23, then succeeding 31 terminates processing having succeeded.

Parameter thresholds

The iterations so far described do not account for the use of thresholds whose levels are varied and which limit the effect of some Preferences 7 and other parameters. This technique has similarities to "Fuzzy logic" in knowledge-based (expert) systems, but is nevertheless deterministic. The purpose of thresholds is to compromise Preferences 7 by degree rather than directly to their weak condition. The best Implementation employs such thresholds and they are described now:

A threshold is associated with the selection of chord specifications 12. Its weak level corresponds to the number of chord specifications 12 for the nominated melody note. Its stronger levels limit the number of chord specifications 12 available.

Similarly, thresholds exist for the allowable leaping of voices 16 and for the preferred chord 13 parts that may be doubled by filling 15.

The thresholds have a hierarchy, the threshold for the chord specifications 12 having the most freedom and that for the doubling having the least. Controlling 32 imposes limiting 33 to compromising 34 such that those thresholds below the chord threshold in hierarchy may not compromise their levels beyond that of the threshold immediately above in hierarchy. No threshold level may be compromised beyond that of the same threshold kind at the preceding chord. If there is no such preceding chord, such as at the first nominated melody note or at that following a melody break, exception 35 may compromise the threshold one level, the threshold level above it permitting.

At failures of an iteration corresponding to a threshold, and if, as described above, the threshold level may be compromised, then Preference iteratings 36 does so by one level, and repeats the entire process within said iteration. Upon entry to any such iteration, including the case of advancing 22 to the next nominated melody note 23, subordinate threshold levels are set to their strong value.

The effect of the thresholds is to implement the principle that, after trying several of the better choices corresponding to a given threshold, the Harmonizer, rather than trying a poorer choice, will retreat to the previous parameter or chord to try the next choice there, where it likewise iterates the retreats and advances.

Excessive retreats

Where the Harmonizer encounters difficulty in finding a solution, it may have to retreat by several nominated melody notes, unable in each case, as described above, to compromise threshold levels because of the threshold levels of the previous nominated melody note. That is, no compromising 34 can occur until the Harmonizer reaches the first nominated melody note, or that following a melody break. If the Harmonizer has to retreat more than a few chords, the number of permutations that can be tried compounds so quickly that execution times become unacceptable. In order to break this sequence, and in so doing to imitate human practice, after a few consecutive retreats 37, detecting retreats 38 disregards 39 the previous chord in assessing whether it may compromise threshold levels.

The number of thresholds

The best Implementation employs the three thresholds described above. Derivatives of the threshold levels control other iterations, two examples being the avoidance of unison, and the omission of fifths. Other Implementations employ different combinations of thresholds and their derivatives to similar effect, within the scope of the Claims.

Without thresholds

In another Implementation, there are no thresholds, and the Preferences 7 that would have had thresholds are subjected to the same kind of hierarchical and excessive retreat processes. The harmonies so created would of course still comply with the Rules, but the selection of chords may to some extent be less optimum and the harmony sound less flowing.

Example of Harmonizer main loop

In the best Implementation, the main loop is illustrated by the following pseudo-code:

```
do
  if advancing then reset chord specification threshold
  do
    if advancing then reset progression threshold
    do
      if advancing then reset doubling threshold
      do
        if advancing then reset chord pointer
        do
          configure a chord and evaluate (includes submission to Rules)
          if the chord complies then exit to end of outer loop, to "advance"
        loop if another chord specification is available
      loop while the doubling threshold can be compromised
    loop while the progression threshold can be compromised
  loop while the specification threshold can be compromised set "retreat"
loop while able to advance or retreat
```

Varying Harmony

When variation is set, the Harmonizer, at nominated melody notes of repeating pitch, prefers, depending on the degree of variation set, a change in the allocation of the parts or a change in the chord degree.

Close Harmony

Close Harmony prefers that the interval between a Melody note and that of the next note below it may a) not exceed 3, b) additionally be 6, and c) further additionally be 8, at the user's option.

Leaping

Leaping is assessed by 1) changes in pitch of each part, and 2) total change of pitch in all parts.

Establishing cadences

Middle cadences are established principally by the recognition of longer Melody note durations. The latter of any two potential cadences close together is chosen over the former. This is another feature distinguishing the present invention from real-time devices. Middle cadences also are established at pause marks. Final cadences are established at the end of the Melody, and before section marks where the Melody permits—that is, at tonic, mediant or dominant Melody notes.

Acceptances of each cadence chord and its preceding chord are restricted procedurally to a plurality of chord progressions deemed appropriate for each possible melody progression. In another Implementation, tables of said chord progressions restrict chord acceptance.

A common cadence form comprises a held melody note with a change in the accompanying chords. The Harmonizer can achieve this at tied repeated Melody notes, the user setting the Harmonizer Control "Vary tied cadences". The Harmonizer treats said tied notes as one for recognizing the cadence by duration, but treats the notes separately for the creation of chords. Otherwise, two tied repeated Melody notes are treated as the one second note of a cadence pair.

Modulating cadences

The Harmonizer modulates middle cadences if Melody notes uniquely characteristic of an alternative key are present before and within a bar of the cadence.

Additionally, at the user's Preference, Melody notes within the bar before the cadence are assessed as potential roots, thirds and fifths of the chord to be acceptable at the cadence.

Other Modulation

At each bar and also following middle cadences, the occurrence of a Melody note of longer duration within the bar affects the acceptance of the current chord in that the note at said occurrence is preferred to be a root, third or fifth of said current chord.

In another Implementation, this modulation detection is a user option.

Identifying Chords

The Harmonizer identifies chords without reference to the said chord specifications 12. This ensures that Harmonizer music data 2 are assessed by the Rules as is other music data 2 held in the music storing 1.

Identifying 19 comprises calculating characteristics 40 comprising intervals, semitones and doubling of voices;

calculating characteristics 40 further comprising the degree, mode, species and inversion of chords.

In the best Implementation, notes are defined in part by pitch measured in semitones, and so the semitones between voices is obtained by subtraction. The calculation of each note degree accounts for the scale key, scale mode and any chromatic present to find the scale degree with which the pitch of a note is associated, such that a "tonic" note is represented by 1, "supertonic" note by 2 and so on by unit steps to the "leading" note by 7. In order to distinguish more readily the minor seventh from the leading note, the minor seventh is given the value 14, chosen because of its equivalence to 7 whenever the operation "modulus 7" is performed.

In order to overcome the ambiguity of chromatics, there is for each note a sharp and flat preference which derive from the scale and which can be overridden by the user's use of an accidental. Further, there are two special cases accounted for being 1) the leading note chromatic in the minor mode; and 2) F represented as E# in the scales of F# and D#m. In the best Implementation certain scales are not recognized, one example being C flat, B being preferred.

The interval between two notes is given by: (the difference between the note degrees) mod 7+1.

The inversion and mode are derived from the said intervals and said semitones. In the best Implementation, the chords of the dominant thirteenth are derived by comparison with stored values of intervals and semitones for each inversion, whereas other chords are derived procedurally, each technique deemed appropriate in its case, the procedural technique generally being faster.

Some chord characteristics 40 are ambiguous, and identifying 19 resolves the ambiguity by reference to the chord following the ambiguity. That is, a chord may change its identity during a scan for Rules compliance, such that a chord may be approached as one form and left as the other. This is in accord with the Rules (§661–5). Identifying 19 chooses the alternative most likely to satisfy the rules of progression and resolution. The best Implementation distinguishes the following ambiguities:

sus4c and 7sus4a;
sus9&4a and 7sus4d;
9a and sus9&4b;
7th (without a 5th) and sus9; and
7th (with a 5th) and 9th.

In retreat, identifying 19 ignores a failed chord from the music data 2 lest it affect ambiguities.

Identifying 19 derives the root name (chord degree) from the inversion, the bass degree and the scale key, either directly if the root is present, otherwise by difference from another part. Identifying 19 finds the mode of a chord by reference to the semitones of the third, or, when the third is absent, by reference to the semitones of the third of the chord of resolution. In another Implementation, identifying 19 uses the identity implied by said chord specifications 12. Figured Bass is a chord annotation of part intervals from the bass, certain intervals being omitted by convention.

Submitting the music data 2 to diagnosing 20

The submission comprises identifying 19 chords;

accounting for preceding and following chords and passing notes, as the Rules require; and evaluating compliance 21 with the Rules.

In determining compliance 21, diagnosing 20 looks for reasons to fail the harmony.

The time progression of a voice is calculated as an interval using the same procedure as for intervals between notes of a chord, as described at Identifying Chords above.

In the best Implementation, compliance 21 with the Rules is determined procedurally, and as one example, the two rules §361 and §386 combined are illustrated by the following pseudo-code:

```
VI to V progression
  if the preceding and current chords are at their root
    positions then
    if the preceding chord is of dominant root then
      if the preceding chord is a triad in a minor key or a
        seventh in a major key then
        if the current chord is a submediant triad then
          if the preceding chord has no seventh and no
          fifth then rule §361 fails
          if the third of the current chord has no double
          then rule §386 fails
        end if
      end if
    else if the current chord is a dominant triad then
      if the previous chord is a submediant triad in a minor
        key then
        if the current chord has no fifth then rule §361 fails
        if the third of the previous chord has no double
          then rule §386 fails
      end if
    end if
  end if
```

Monitoring the Harmonizer

In the best Implementation, the Harmonizer displays at output 4 progress along the nominated melody notes as a bar, brightened according to compromises of the Preferences 7. In another Implementation, the Harmonizer displays at output 4 progress along the nominated melody notes, showing all chords which satisfy the Rules. The Harmonizer regularly adjusts the output 4 so that the area of interest is centred. At each nominated melody note the Harmonizer displays at output 4 a Melody note position number (its array subscript); the chord parts by number against each voice; the nature of the beat (pulse); the degree of the Melody note by number according to the current scale; and the degree, species and inversion of the chord. The output 4 brightens the beat symbol at cadences, and brightens a part number if its octave option is taken. Any changes of key encountered during advance or retreat are accounted for in the selection of chord specifications and in the Rules, and the current key and rhythm are displayed. The user has the option of quitting the Harmonizer process prematurely.

An Implementation additionally incorporates an optional trace facility whereby the user may set a trigger point and may step through the Harmonizer process by single selected chord-specification steps or by advance and retreat steps. In the trace mode, performance is not an issue, and so the output 4 can afford to display more information. Therefore, details of failed chords are also displayed, together with reasons for their failure. Commands allow normal (non-trace) mode to resume, the setting of another trigger point, or an immediate quit of the Harmonizer process.

Scanning for beat

Some rules require knowledge of the position of accents. One example is that suspensions must lie on an accent. All music data 2 held in the music storing 1 has defined, by default or by the user, the rhythm and the number of beats in the first bar. The Harmonizer determines the position of bars, accents and beats by accumulating, in each voice, note and rest durations, and by comparing the accumulations with said rhythm or with the rhythm as it changes in the course of the music data 2. In an Implementation, where the Harmonizer detects discrepancies between voices or notes overlapping a bar, the Harmonizer indicates bar errors on the output 4 by an identifiable colour.

Error Display succession

In an Implementation, any music data 2 held within the music storing 1 is subjected to analysis according to identifying 19 and diagnosing 20. Harmony failures are stored in a circular data array (that is, a conventional array in which the subscripts are circular). Error Display succession minimises the use of the output area. After the text of a breach has been displayed for a short time, the output 4 selects the next breach in the array and displays it in the same place. The output 4 detects 1) the absence of any breaches so that other less significant messages can be displayed, and 2) the presence of only one breach so that there is no unnecessary display flicker.

Transposition

An Implementation provides transposition means for transposing music data 2. Transposition includes appropriate changes of key and the maintenance of appropriate chromatics, by the use of the same data employed in said ambiguity of chromatics. Means for transposing the Melody can be particularly useful when the Harmonizer has difficulty due to the Melody being too high or too low.

Searching for Chords

An Implementation provides search means for searching for chords. Searching makes use of the identifying 19 of chord characteristics 40 deriving from "identifying chords". The music data 2 is searched for occurrences of chords having characteristics defined by the user. The user may leave some search characteristics undefined, so that the search may be, as one example, for all dominant thirteenths regardless of their inversion. The search means searches from the current cursor position and places the cursor at the next chord matching the search criteria.

Merging Repeats

An Implementation provides merge means for combining notes. At the user's option, a harmony is refined by merging repeated notes in user-nominated voices into single notes of equivalent time by combination. Merges are limited such that the times of combination do not exceed a user-specified time. At the user's option, merges are limited to tied notes. Merging accounts for music theory rules concerning accents, and requires that the times of the combinations can be represented by musical notation, so that not all repeated notes are necessarily merged. Merging tied repeated notes is useful in the Melody voice after "Vary tied cadences" described above. Note that where several voices of a chord become merged, there may remain only passing notes, and harmony errors may be so introduced. Merging is therefore done after the completion of a harmony.

Other Implementations

Those skilled in the art will appreciate that other Implementations are possible within the scope of the Claims. So the invention may be practiced other than as described above. One example provides for hardware input 5 and output 4 of music data 2; and another example provides invocation 6 comprising hardware switches and controls.

Notes concerning the Claims

The claims reference the definitions under "(e)(1) Field of the Invention".

Representative List of Harmony Rules

The paragraph numbers are those of Reference 1, beginning at §250, there being an earlier volume, not of harmony rules. Only strict ("must") rules are shown, unless otherwise stated. The missing paragraphs cover definitions, explanations, and preferred practice implemented as the Preferences.

Some rules continue the topic of preceding paragraphs—each rule should be read in its context.

There are certain apparent ambiguities and contradictions and the best Implementation reconciles them, one example being rule §328.

Harmony rules

275 Three or more notes sounded together constitute a chord.

292 Voices must not cross nor overlap.

328 If the bass of a major first inversion is doubled, the two voices must move to and from the chord by step in contrary or oblique motion.

Interpretation: understood not to apply when the chord repeats, nor to augmented fifths.

332 Where the bass of consecutive four-voice first inversions moves by step, no one chord part shall be doubled in both chords.

337 The second inversions of only the tonic, dominant and the subdominant common chords are permitted. (But see §603, §608, §636, §647)

342 The bass must not leap to a second inversion from a first inversion of a different root.

344 The bass of a second inversion must not leap, except from arpeggio to the first inversion of the same chord.

345 A second inversion, followed by a chord on the same bass note but not preceded by a chord on the same bass note, must occur on the accent of the bar.)

346(a) The only consecutive second inversions permitted are of the dominant root followed by the subdominant root. (b) No voice may move in consecutive fourths with the bass.

353 In a minor key, the major sixth may not be used as part of a chord, except in the major (chromatic) chord of the supertonic (see §596) and its derivative (see §603).

Concession: This rule can force very unsatisfactory harmony when the major sixth occurs in the melody. Reference 3, Chapter 9 regards any note of the melodic minor as legitimate in a chord. The best Implementation implements §353 for other than the Melody voice. In practice, other rules, particularly §445, result in the Harmonizer producing appropriate modulation near the sixth.

361 When a chord of the dominant moves to a chord of the submediant, or vice versa, in a minor key, the dominant must be complete, and the third must be doubled in the submediant.

369 The minor seventh may be used in a chord as the bass of a first inversion only in a minor key where it is preceded by the tonic and followed by the minor sixth.

375, 486, 7 The seventh of a dominant seventh resolves by falling a second, rising a semitone, or remaining. The third resolves by rising a second, falling a semitone, or remaining.

379 No note may proceed by similar motion to the note (or 8ve) on which a dissonant note resolves.

377 No dissonant note may be doubled.

380 Subject to §375 etc above, the dominant seventh may resolve to any chord.

381 In resolving to the tonic, the seventh falls a second, and the third rises a second.

384 In resolving to the submediant, the seventh falls a second, and the third rises a second.

386 A submediant triad following a dominant seventh in a major key must double its third.)

387(a) Before resolving, a seventh may first proceed to the root or the fifth of the chord—ornamental resolution, or, (b) before resolving, the seventh may transfer to another voice.

400 The dominant seventh may rise only from a second inversion to a tonic triad first inversion.

405 In addition to or in combination with §387(b), different inversions may follow, subject to §400.

414 Secondary sevenths must be prepared.

415 "Preparation" refers to the sounding of a note in the same voice before the chord in question. The preparation must be consonant.

416-23 In a secondary seventh chord, the seventh resolves by falling a second. The root rises a fourth to the root of the resolution. Note, however, that some sevenths are identical to inverted ninths, and may therefore have their resolutions. (§578). Note also §517.

420 The second inversion of secondary sevenths is not used.

428 No voice may move a major seventh nor more than an octave.

429–30 A voice should not move by an augmented interval, except (a) resolving a note to a harmony note, (b) in a sequence (not formally implemented in the best Implementation), and (c) as passing notes in the harmonic minor.

Concession: the Melody is exempted for the sake of (b).

431 A voice moving by a diminished interval should return to a note within that interval.

433 The leading note must not be doubled. (a) The leading note in a perfect cadence must rise to the tonic; otherwise, (b) when the leading note is followed by a tonic chord, it must rise, but not necessarily to the tonic. (§298c not shown says better, which is implemented)

434 No two voices may move in perfect fifths.

436 The extreme voices may not move in fifths (perfect or diminished).

437–9 No two voices may move in octaves or unisons, unless a unison or octave passage is intended.

440–1 Hidden consecutive perfect fifths and perfect octaves of the extreme voices are prohibited except where a tonic chord moves to a dominant or subdominant or vice versa, the upper voice moving by step, or a chord moves from its first inversion to the root. Also see §500e, §535 & §536.

Concession: except the third of the first chord falling to the fifth of the second; or the upper voice moving by step—Ref. 2, p36.

443 No two voices may move in consecutive seconds or sevenths.

445 False Relation: a note in one chord having appeared in the previous chord or previous but one chord chromatically altered (or vice versa) must be in the same voice, except as in §446, 7, 9.

446 The earlier note (§445) may be doubled (but note rule §437).

447 False relation does not occur if the third of the first chord is the root or fifth of the second, nor when the altered note forms part of a fundamental discord.

449 Passing notes and their allies do not produce false relation.

485–7 (includes §375, §381–4, 7, §400) In a dominant seventh chord, the seventh may only fall a second, rise a chromatic semitone, remain to be a note of the next chord, transfer to another voice, or, where the second inversion is followed by a tonic first inversion, rise a second. The third may only rise a second, fall a chromatic semitone, or remain.

492c A suspension must resolve by proceeding by step (§493) to a harmony note on the chord over which it is suspended (but see §506).

495 The suspended ninth resolves by falling to the eighth.

500a A suspension must be prepared (§415).

500b A suspension must occur on an accent.

500e No suspension is allowed if in its absence forbidden consecutives would occur.

500g A second cannot resolve on a unison (covered by §554).

506 Some interchange of parts is allowed in the resolution of a suspension, but if a voice moves to the note of resolution, it must be by contrary motion.

507 The suspended fourth resolves by falling to the third.

510 In the first inversion of a suspended fourth, the fourth is a ninth above the bass (see §554, reading fourth for ninth and third for root)

517 The leading note can be a suspended seventh of the tonic, resolving to the eighth. (cf. §416)

519, 520 Suspensions may resolve ornamentally, moving to other harmony notes of the same chord, or as passing or auxiliary notes, provided the correct resolution occurs before the chord changes.

535 Passing notes in several voices at once must move by contrary motion unless they make satisfactory combinations.

Interpretation: "satisfactory combinations": Ref 2, p80 states that they usually move in thirds or sixths. The best Implementation requires that, unless they are moving contrary, the two notes should maintain their interval, and lets the rules for consecutives catch the illegal ones. Three passing notes are deemed to form a new chord, with all that that entails (§275).

536 Rules §434 to §443 (that is, chord to chord) apply also in the presence of passing notes.

537 Passing notes must not introduce the prohibited consecutives.

548 The dominant ninth may be major or minor.

550 The major ninth may not be used in a minor key—see §353.

552 Unless it descends at once to the root, the major ninth must be above the third.

553 The dominant ninth resolves by rising or falling a second. The rest of the chord may remain (dominant seventh), or (see §555).

554 A resolution must not be sounded with the dissonant note, except that, where a ninth resolves onto the root, the root may be sounded in the bass.

555 The dominant ninth may resolve to a tonic common chord, the ninth falling a second.

557 The root is omitted from inverted ninths.

558 The fourth inversion of the major ninth is not permitted.

574,5 A secondary ninth resolves by falling a second. The root rises a fourth. The ninth should be above the third (but see §614 and §416).

576 Where an inverted secondary ninth, not being a third inversion, has no root, the seventh is not dissonant and therefore does not require resolution.

582 The dominant eleventh resolves by rising or falling a second, the rest of the chord remaining (dominant ninth) (or the ninth may also resolve); or remaining, the chord of resolution being a tonic common chord or a supertonic discord.

584 The seventh and ninth are subject to the rules of the dominant seventh and ninth except that where an inverted dominant eleventh has no root, the seventh and ninth are not dissonant and therefore do not require resolution.

587,590 The dominant thirteenth is rarely complete in practice. Either or both the ninth and thirteenth may be minor. Notes up to the eleventh are treated as in the dominant eleventh.

588 The dominant thirteenth may resolve by step while the rest of the chord remains, or the chord may resolve to a tonic chord, the thirteenth remaining, rising a semitone, or leaping to the tonic.

589 (Note 2) "Rising a semitone" only in major keys, the minor thirteenth rising to the tonic major third.

591 If the major thirteenth chord resolves on to a tonic chord, the thirteenth must leap to the tonic. (c) The thirteenth must be sounded above the seventh, except when the thirteenth is in the bass.

596 In the major common chord of the supertonic, the third must not be doubled, and it rises or falls a semitone to the following chord. The chord of resolution must be some form of tonic common chord, or a chord containing a diatonic fourth, otherwise modulation occurs.

Interpretation: The best Implementation allows modulation to a dominant chord.

602 The supertonic seventh (that is, a fundamental discord) must fall a second or remain. In the latter case it may be doubled, and one of the two may leap. §596 applies to the third.

603 In the second inversion the root may be omitted and the seventh doubled (as §641).

605 The tonic seventh (that is, a fundamental discord) must be followed by a dominant or supertonic discord, or a subdominant chord.

606 The tonic seventh third may rise a second or fall a semitone.

607 The tonic seventh must fall a second or remain. It may not be doubled (cf §602).

608 The tonic seventh may be used in each inversion.

611,2 The supertonic ninth (that is, the fundamental discord) resolves by rising or falling a second, the chord following the rules for the dominant ninth. Alternatively, it may resolve on to a dominant discord, falling a second, remaining, or, if minor (ninth), rising a semitone.

614 The omission of the root and the positions of the third and major ninth are as for the dominant ninth—see §552, 4, 7.

633 The augmented sixth on the minor sixth resolves on (a) the tonic common chord or inversions, (b) the dominant common chord or inversions, (c) an inverted dominant ninth, or (d) a supertonic discord.

634 The notes forming the augmented sixth interval should not proceed in similar motion. The other notes proceed as for supertonic discords: the third as for the seventh and the fifth as for the ninth.

Interpretation: The motion requirement is not mandatory, but the best Implementation requires it.

636 The augmented sixth may be used in the second inversion.

638 The augmented sixth on the minor second resolves in the equivalent manner of §633, except that in minor keys the tonic common chord is not permitted.

640 The diminished triad on the leading note must double only the third. The other notes are resolved as in their parent dominant seventh.

641 In the first inversion of that triad, the subdominant may be doubled, the upper falling and the lower rising.

642 The augmented fifth of the mediant in minor keys must be prepared, and is resolved by rising a second. The root rises a fourth to a common chord.

644, 5 The augmented fifth may be used in the relative major, that is, on the tonic, in which case the fifth is best approached by a semitone step. The best Implementation requires it.

646 The augmented fifth may be used on other notes of the scale.

647 The augmented fifth may be used in the second inversion, as well as root and first inversions.

661–5 Modulation by enharmonic change is described, the point here being that a chord may be approached in one key and left (resolved as necessary) in another, the Rules being applied in each context.

References for the Rules

1. Longmans' Music course Part II—Harmony and Counterpoint, T H Bertenshaw, Longmans Green and Co., London, 1926

2. Harmony Step by Step, Dulcie Holland, EMI Music Publishing, ISBN 0 86947 1449

3. The New Harmony Book, Frank Haunschild, AMA Verlag GmbH, Bruhl, 1994, ISBN 3-927190-68-3.

What is claimed is:

1. An automated music harmonizer for harmonizing melody comprising music storing means for providing music storage of music data according to voice and to time order;

specification storing means for providing chord specification storage of a plurality of chord specifications of species, degrees and parts for each of a plurality of note degrees and note chromatics;

selecting means for selecting from said chord specification storage a chord specification for the degree and the chromatic of a Melody note of said music data;

creating means for creating in accordance with said chord specification a chord of parts to accompany said Melody note;

filling means for doubling and omitting parts in said chord of parts in accordance with harmony rules, as required to fill accompanying voices;

writing means for placing said chord of parts into said music storage at said Melody note;

control testing means for testing said music data up to the current Melody note for compliance with Controls;

preference testing means for testing said music data for compliance with Preferences;

identifying means for calculating characteristics comprising intervals, semitones, doubling, degree, species, inversion and modes of said music data;

diagnosing means for testing said music data for compliance with a plurality of rules of harmony;

re-assigning means, for the case of any failure of said testings for compliance with Controls, Preferences and plurality of rules of harmony, for permutating said parts, doubles and omissions, and for iterating said filling, writing, identifying and testings for compliance;

nested Preference iterating means, for the case of all said permutations failing said testings for compliance, for compromising from inner to outer one of the Preferences by one of a plurality of steps from strong to weak and for iterating the processing of said permutations;

controlling means for limiting Preference compromises, such that a Preference may not be compromised further than the compromise of the corresponding Preference at the Preceding Melody Note nor be compromised further than the compromise of the next inner limited Preference at the current Melody note;

exception means, for the case without a Preceding Melody Note and without an inner limited Preference, for compromising the limited Preference;

chord iterating means, for the case of all Preference compromises failing said testings for compliance, for selecting the next of said chord specifications and for iterating the chord processing so far described;

retreating means, for the case of all chord specifications failing, for retreating to the Preceding Melody Note and for continuing said selection of chord specifications and said chord processing iterations at said Preceding Melody Note as if the chord established there had failed;

failing means, for the case of no Preceding Melody Note, for ending harmonizing;

advancing means, for the case of passing said testings, for advancing to the next Melody note for which a chord is required and for restarting said selection of chord specifications and said chord processing iterations; and succeeding means, for the case of no next Melody note for said advance, for ending harmonizing.

2. The automated music harmonizer of claim 1 wherein the order of the iterations of the several controlled Preferences and the selection of chord specifications is altered.

3. The automated music harmonizer of claim 1 further comprising means for detecting several said retreats without said advances whereupon said compromise of a controlled Preference disregards said corresponding Preference at the preceding Melody note.

* * * * *